US005357778A

United States Patent [19]

Tsai

[11] Patent Number: 5,357,778

[45] Date of Patent: Oct. 25, 1994

[54] AUTOMATIC REINFORCED BAR BENDING APPARATUS

[76] Inventor: Wen-Sheng Tsai, No. 14, Lane 11, Alley 193, Chungcheng N. Road, Sanchung City, Taiwan

[21] Appl. No.: 133,361

[22] Filed: Oct. 8, 1993

[51] Int. Cl.[5] ..... B21D 7/02; B21D 43/12

[52] U.S. Cl. ..... 72/306; 72/217; 72/424

[58] Field of Search ..... 72/306, 307, 424, 387, 72/388, 217–219

[56] References Cited

U.S. PATENT DOCUMENTS 4,763,506 8/1988 Zeng ..... 72/306
4,766,756 8/1988 Shiue ..... 72/306
5,182,932 2/1993 Ritter ..... 72/306

FOREIGN PATENT DOCUMENTS 209424 12/1983 Japan ..... 72/306
206119 11/1984 Japan ..... 72/306

*Primary Examiner*—Daniel C. Crane
*Attorney, Agent, or Firm*—Morton J. Rosenberg; David I. Klein

[57] ABSTRACT

An automatic reinforced bar bending apparatus comprising a dispensing machine, a feeding machine, and a bending machine is provided. The apparatus is operated in such a manner that the dispensing machine dispenses from a large number of reinforced bars a predetermined quantity and delivers the same to conveying arms of the feeding machine in sequence. A number of toothed wheels and driving chains of the feeding machine smooth and transfer the reinforced bars to the bending machine for bending, whereby multiple reinforced bars are continuously bent into square frames with reduced time and labor. Before the reinforced bars are conveyed to the bending machine, they are also accurately counted.

5 Claims, 11 Drawing Sheets

AUTOMATIC REINFORCED BAR BENDING APPARATUS

BACKGROUND OF THE INVENTION

The present invention relates to an automatic reinforced bar bending apparatus composed of a dispensing machine, a feeding machine, and a bending machine.

In the conventional reinforced bar bending apparatus, a conveying machine and several bending machines disposed in front of the conveying machine are used to transfer multiple reinforced bars from the conveying machine to the bending machines for bending operation. The bending machines bend the reinforced bars by means of cam members in a continuous manner, whereby the multiple reinforced bars can be simultaneously bent into square frames for constructional use at reduced operation time and labor cost while the quality of finished products can be highly enhanced. However, it is found that improvements for the conveying procedure thereof are still needed to meet the requirements of automated operation for mass production of bent reinforced bars.

SUMMARY OF THE INVENTION

It is therefore a primary object of the present invention to provide an automatic reinforced bar bending apparatus composed of a dispensing machine capable of dispensing an adequate small amount of reinforced bars from a large pile, a feeding machine capable of feeding and smoothing the small pile of reinforced bars delivered from the dispensing machine, and a bending machine capable of simultaneously bending multiple reinforced bars into a square frame for constructional use. With the present invention, a lot of time and labor can be effectively saved and the production efficiency is largely increased. Moreover, the numbers of bent reinforced bars can be counted at the same time.

BRIEF DESCRIPTION OF THE DRAWINGS

The structural feature and advantages of the present invention, and the technical means adopted to achieve the present invention can be best understood through the following detailed description of the preferred embodiment and the accompanying drawings wherein.

DETAILED DESCRIPTION OF THE PREFERRED EMBODIMENT

Figure 1:
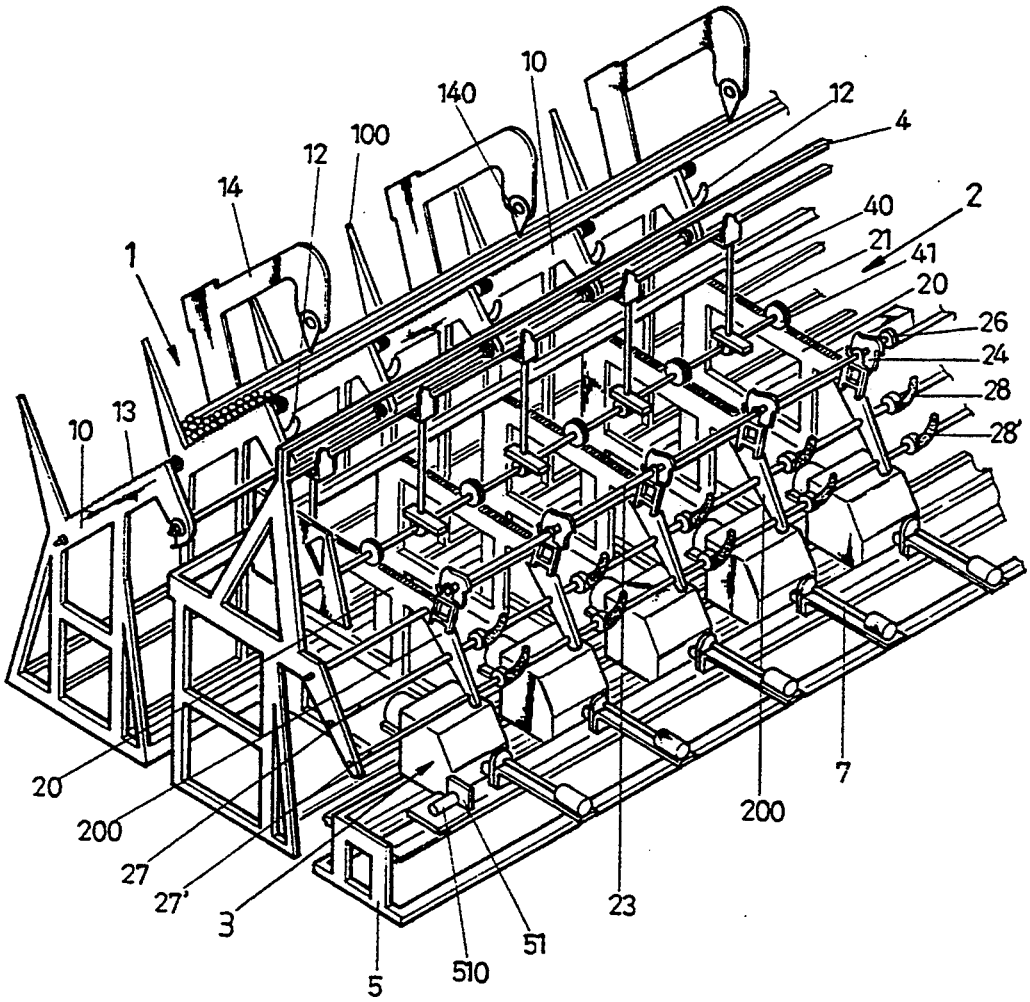
FIG. 1 is a partial perspective of the present invention.
Figure 2:
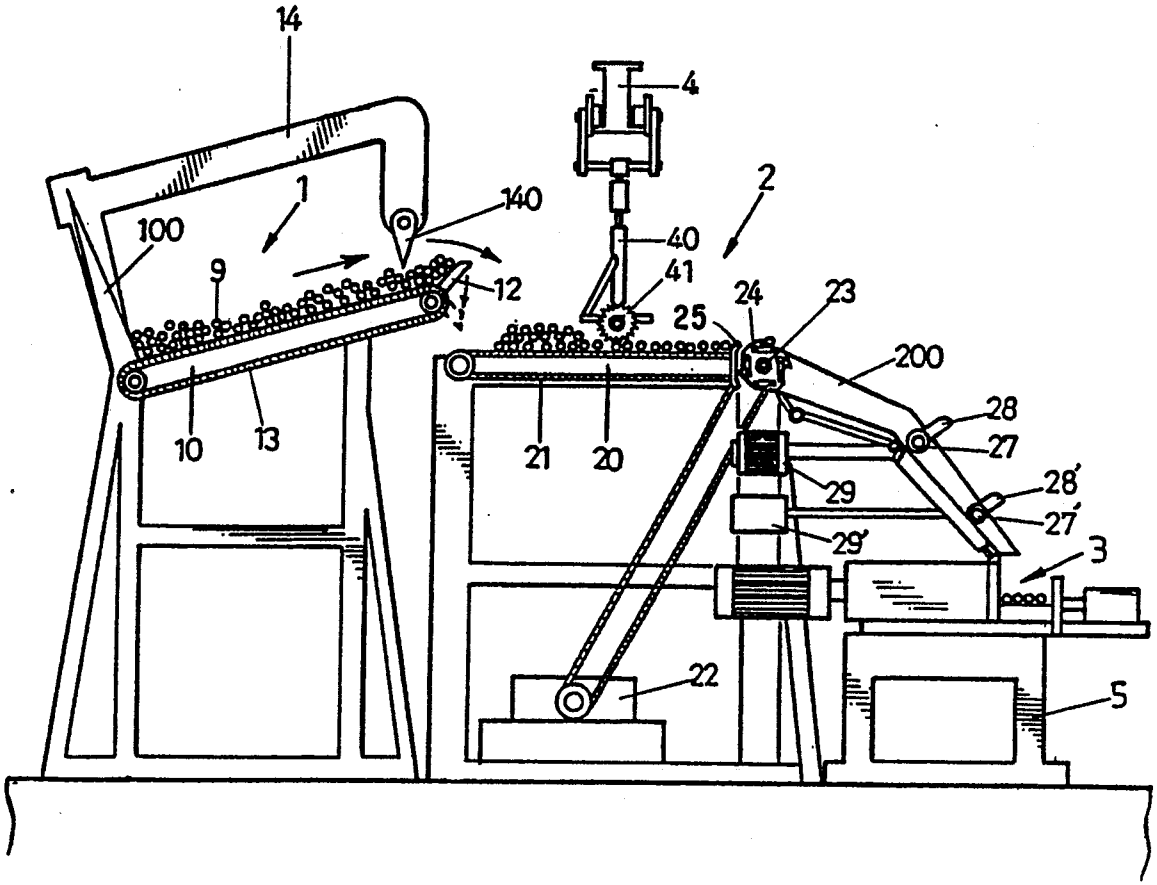
FIG. 2 is a side elevational view according to FIG. 1.
Figure 3:
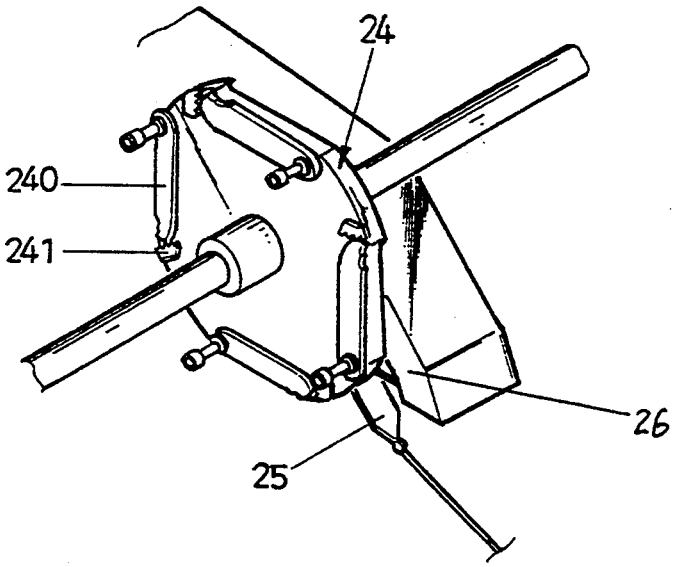
FIG. 3 is an enlarged perspective view of a catch disk of the present invention.

Please refer to FIGS. 1 and 2. The present invention is composed of a dispensing machine 1, a feeding machine 2, and a bending machine 3. The dispensing machine 1 is used to separate an adequate small amount from a large number of reinforced bars and deliver the separated reinforced bars to the feeding machine 2. The feeding machine 2 is located at a lower front of the dispensing machine 1 and is used to feed, smooth and count the small amount of reinforced bars dispensed and delivered by the dispensing machine 1. The bending machine 3 is located at a lower front of the feeding machine 2 and is used to bend the reinforced bars after the same are dispensed and delivered from the machine 1 through the feeding machine 2 to the bending machine 3.

As shown in FIGS. 1 and 2, the dispensing machine 1 has a main-frame in a predetermined length, a plurality of upward inclined supporting arms 10 disposed on a top portion of the main-frame at a predetermined interval and having a downward extending front end and an upward extending rear stop member 100, a plurality of dispensing arms 14 each disposed between two adjacent supporting arms 10 and having a pivotally connected conic dispensing plate 140 at its front end for moving excessive reinforced bars toward the stop members 100 of the supporting arms 10, and a shaft rod 11 disposed at the front end of the supporting arms 10 and having stop plates 12 pivotally coupled thereto each near one side of a supporting arm 10 and whose rotatable displacement is responsive to a control signal from a microswitch (not shown) disposed below the very stop plate 12 at one lateral end of the dispensing machine 1 (in this case, it is the stop plate 12 illustrated at an upper right portion of FIG. 1). Each of the supporting arms 10 further has a first driving chain 13 which is connected with a first motor (not shown) located under the dispensing machine 1 via a rotary shaft of the first driving chain 13.

Again referring to FIGS. 1 and 2. The feeding machine 2 has a main-frame in a predetermined length corresponding to that of the dispensing machine 1, a plurality of conveying arms 20 disposed on a top portion of the feeding machine 2 corresponding to the supporting arms 10 of the dispensing machine 1 in both the numbers and the spaced intervals and each having a downward extending tapered front extension 200, and a sliding carriage 4 disposed above the main-frame of the feeding machine 2. The sliding carriage 4 consists of a plurality of downward extended rods 40 each of which has a toothed wheel 41 rotatably disposed at a lower end thereof. The level of the wheels 41 is such that the reinforced bars are permitted to pass through the clearance between the wheels 41 and a top surface of the second driving chain 21 one at a time. The conveying arms 20 each is further provided with a second driving chain 21 which is connected to a second motor 2 located under the feeding machine 2, a driving shaft 23 disposed on the conveying arm 20 near a front side of the second driving chain 21, a catch disk 24 disposed on the driving shaft 23 at one side of the conveying arm 20, and a vertical stop plate 25 disposed between the catch disk 24 and the second driving chain 21 such that the vertical stop plate 25 is connected with a clutch control box (not shown) of the second driving chain 21. When a reinforced bar is fed by the second driving chains 21 to contact the vertical stop plates 25, the vertical stop plates 25 control the clutch control boxes to lock and stop the second driving chains 21 or to release and permit the second driving chains 21 to go forward.

The catch disks 24 each have four catch levers 240 each of which has a front concave hook section and is pivotably secured to one of four corners of the catch disk 24 by a bolt. The front end of the catch lever 240 abuts against a toothed adjusting block 241 fixed to the catch disk 24 whereby when the bolt of the catch lever 240 is loosened, the catch lever 240 can be pivoted about the bolt for adjusting inclined angle of the catch lever 240 relative to the catch disk 24 and thus moving the hook section thereof between a protruded position where the hook section extends out of the periphery of the catch disk 24 and a retracted position where the hook section retracts inside the periphery of the catch disk 24. A sensor 26 is disposed on an outer side of the very catch disk 24 disposed at a lateral end of the feeding machine 2.

Two parallelly spaced shafts 27, 27' are disposed between every two adjacent tapered front extensions 200 of the conveying arms 20. Two arch hook-like stop plates 28, 28' are correspondingly disposed on the parallel shafts 27, 27', respectively, and are actuated by two first pneumatic cylinders 29, 29' disposed behind the stop plates 28, 28', respectively.

Figure 4:
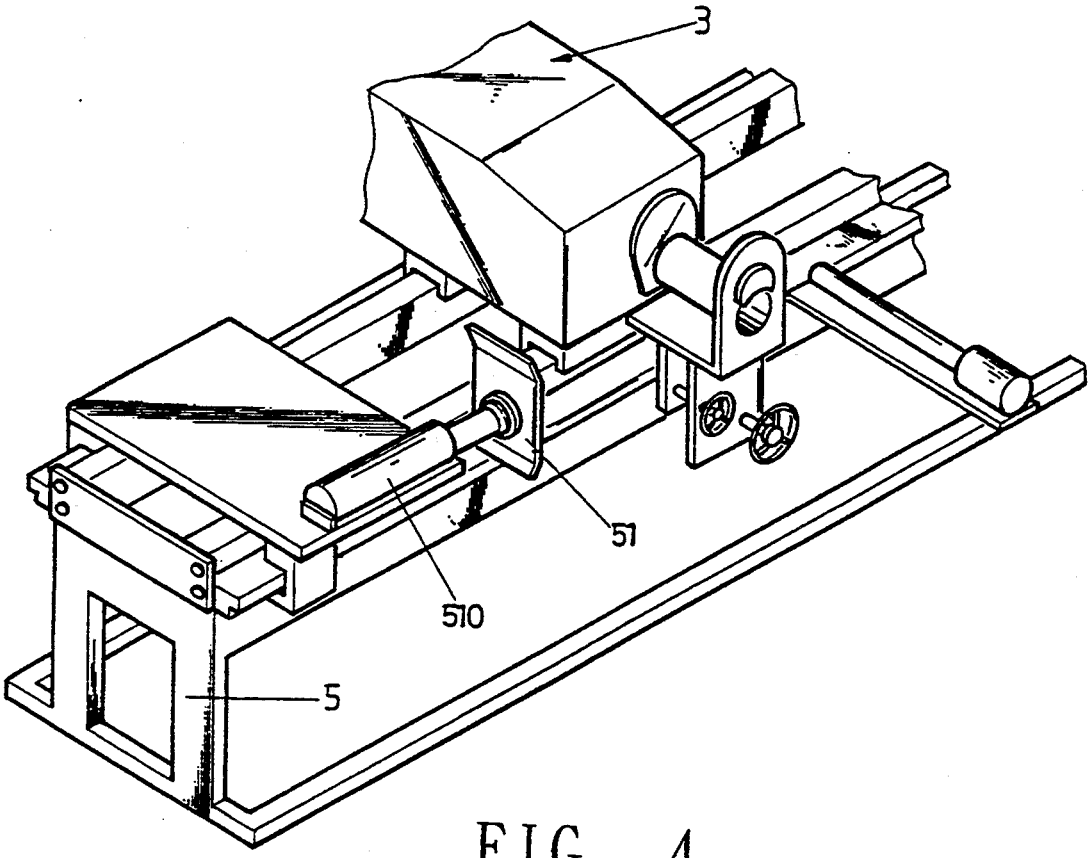
FIG. 4 is a fragmentary and enlarged perspective view of a bending unit of the bending machine of the present invention.
Figure 5:
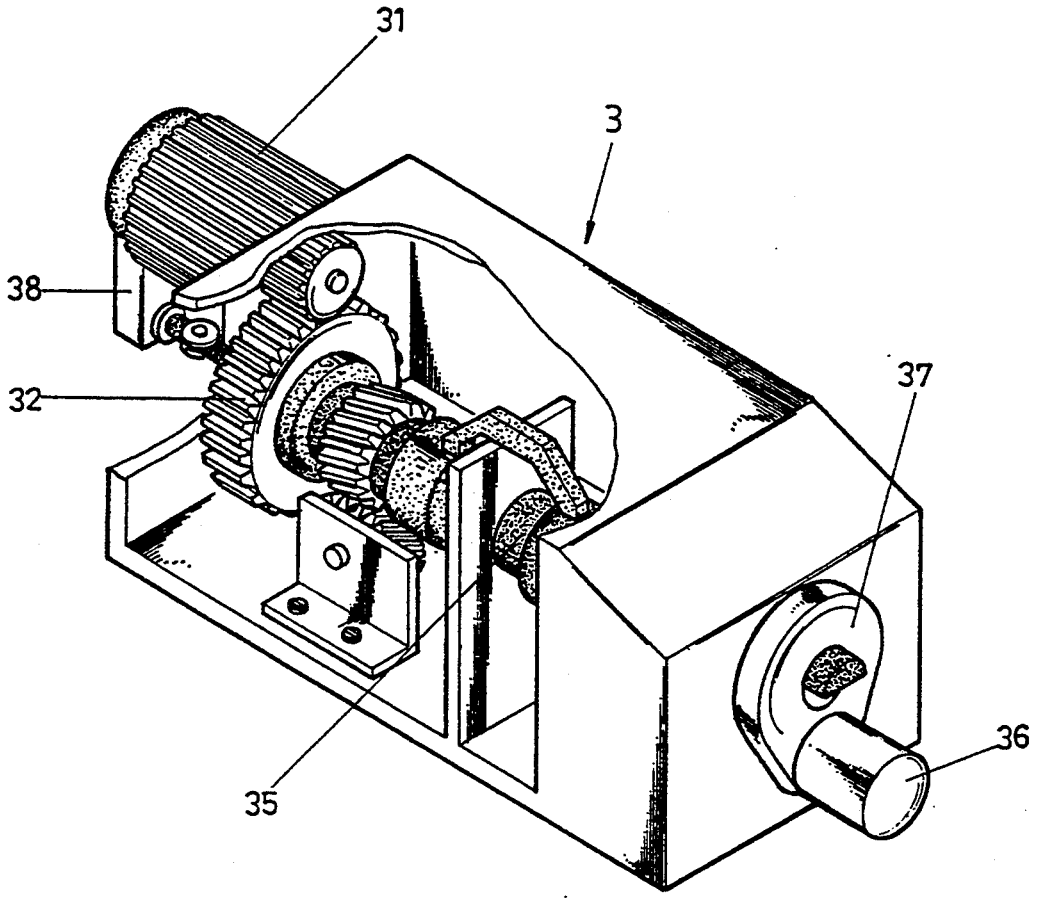
FIG. 5 is a fragmentary and enlarged perspective view of the bending unit, wherein a part thereof is taken away to clearly show the inner structure thereof.

Referring to FIGS. 1 and 4. The bending machine 3 is slidably seated on a base 5. The base 5 has a left aligning board 51 and a right stopping board (not shown) fixed to a left and a right end thereof, respectively. The movement of the left aligning board 51 is controlled by a second pneumatic cylinder 510 disposed at left side thereof for aligning one end of the reinforced bars to be bent. The bending machine 3 consists of a plurality of bending units (in this embodiment five units are illustrated) each of which is powered by a driving motor 31 mounted behind the bending unit (with reference to FIG. 5). The driving motor 31 drives a main shaft 35 inside the bending unit by engaging with a gear set 32 connected with the main shaft 35. A third pneumatic cylinder 38 is connected behind the gear set 32. The main shaft 35 has a front end slightly protruded out of a front portion of the bending unit 3 such that an operating disk 37 is fitted over the protruded front end of the main shaft 35 and a projected shaft 36 is fixedly disposed on one end of the operating disk 37 opposite to the main shaft 35.

Figure 6:
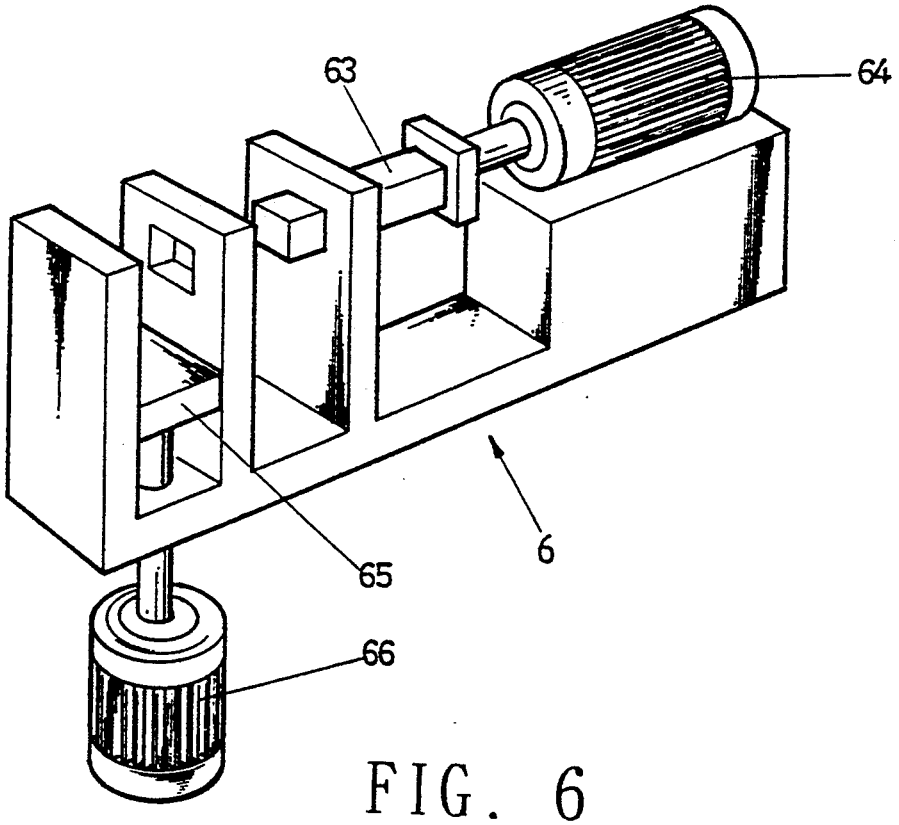
FIG. 6 is a perspective view of the reinforced bar fixing support of the present invention.

Please refer to FIGS. 1 and 6. A reinforced bar fixing support 6 is disposed at one side of a middle bending unit of the bending machine 3. (In FIG. 1, the fixing support 6 is blocked from view by the middle bending unit of the bending machine 3 and is not shown.) The fixing support 6 consists of a longitudinally extended pressing rod 63 which is connected at a rear end to a horizontal pneumatic cylinder 64 and is controlled by the same, and an elevating board 65 disposed near a front portion of the fixing support 6 with a vertical pneumatic cylinder 66 connected to a lower end of the elevating board 65 so that the elevating board 65 can be driven to move up and down in cooperation with the horizontal extending or retracting of the pressing rod 63 to firmly locate the reinforced bar to be bent.

Figure 7:
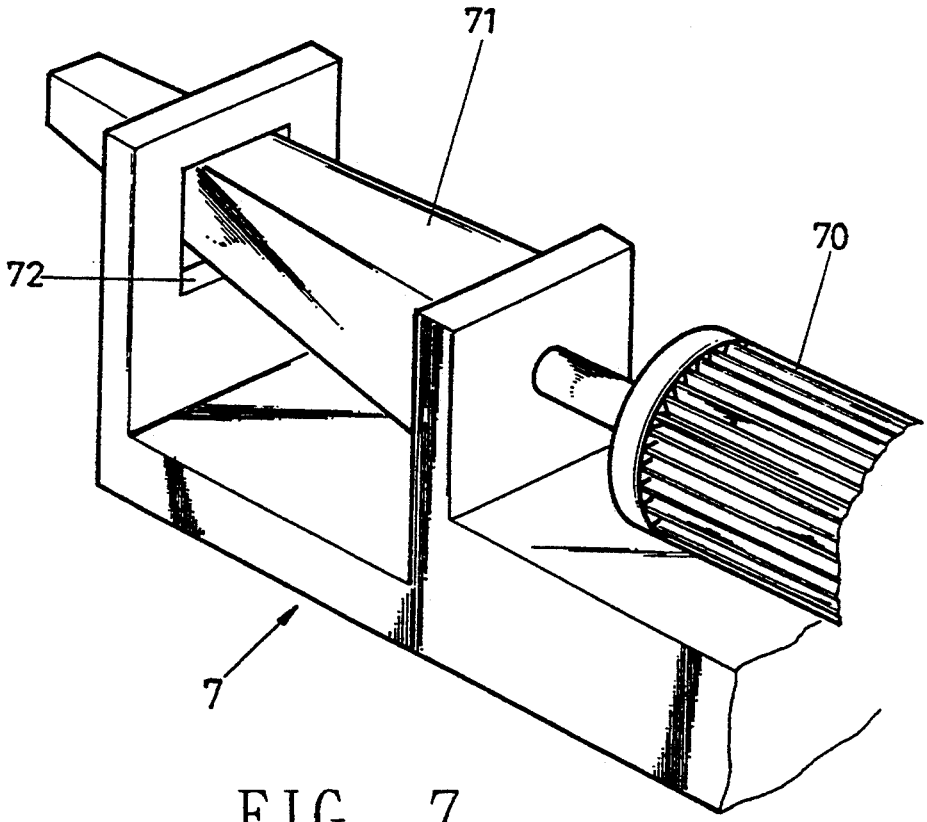
FIG. 7 is a perspective view of the adjusting device of the present invention.

Please now refer to FIGS. 1 and 7. A reinforced bar adjusting device 7 is disposed in front of each bending unit of the bending machine 3. The adjusting device 7 has a front plate on which a square hole 72 is formed for a tapered adjusting rod 71 to extend therethrough. A fourth pneumatic cylinder 70 is connected to a enlarged rear end of the adjusting rod 71.

Figure 8:
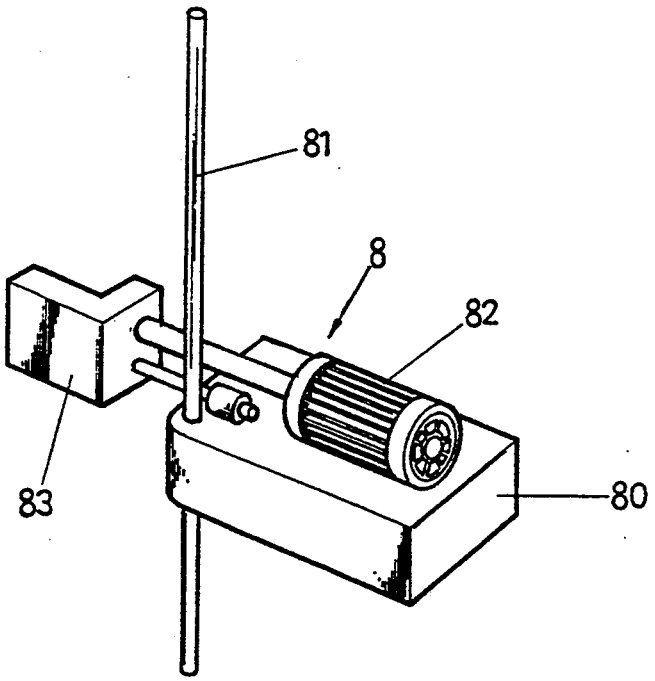
FIG. 8 is a perspective view of the displacing arm of the present invention.

Please refer to FIGS. 1 and 8. A biasing arm 8 is disposed next to the reinforced bar adjusting device 7 disposed in front of the second bending unit of the bending machine 3 (when viewing FIG. 1 from left to right). The biasing arm 8 includes a support seat 80, a rod member 81 connected to the support seat 80, a fifth pneumatic cylinder 82 disposed on the support seat 80, and an L-shaped pushing member 83 connected to a front end of a plunger of the cylinder 82 for pushing and moving the reinforced bar.

According to the above arrangements, as shown in FIG. 2, a large number of reinforced bars 9 can be placed on the supporting arms 10 of the dispensing machine 1 and be moved forward by the first driving chains 13 thereof. When a predetermined amount of reinforced bars 9 are moved to the stop plates 12 of the dispensing machine 1 and touch the microswitch at one lateral end of the dispensing machine 1, the first driving chains 13 are stopped and then reversely rotated so that the reinforced bars 9 which have not entered the stop plates 12 are moved back down toward the stop members 100 of the supporting arms 10 by the dispensing plates 140 of the dispensing arms 14. Meanwhile, the stop plates 12 are actuated by the microswitch to turn downward, permitting the reinforced bars 9 located thereon to fall down to the conveying arms 20 of the feeding machine 2. This smaller quantity of reinforced bars 9 are then transferred by the second driving chains 21 of the feeding machine 2 toward the front side of the conveying arms 20. When the reinforced bars 9 gradually move to a position under the toothed wheels 41 of the sliding carriage 4, the reinforced bars are allowed to pass through the clearance between the wheels 41 and the top surface of the second driving chains 21 one at a time, therefore, the reinforced bars 9 passed the toothed wheels 41 will not superpose with one another. After passing through the wheels 41 one by one, the reinforced bars 9 move to the front end of the conveying arms 20 and touch the vertical stop plates 25, making the same to control a clutch inside the clutch control box to lock and stop the second driving chains 21, allowing the reinforced bars 9 to enter the catch levers 240 of the catch disks 24 one by one. Once the sensor 26 detects that a reinforced bar 9 is located in the catch disks 24, the second motor 22 is actuated to rotate the catch disks 24 and move the reinforced bar 9 caught by the catch lever 240 down to the stop plates 28 of the shafts 27. It should be noted that each time the catch disks 24 take a reinforced bar 9, the sensor 26 counts once. When the counted number reaches a preset number of the reinforced bars to be bent, the catch disks 24 stop taking the reinforced bars 9. Moreover, after each rotation of the catch disks 24, a locating sensor will inform the catch levers 240 thereof the right position to stop so that the hook sections of the catch levers 240 can be located at a fixed position and wait to take the next reinforced bar 9.

When the numbers of the reinforced bars fallen into the stop plates 28 reach the preset number, the first pneumatic cylinders 29 behind the stop plates 28 drive the same to turn downward, letting the reinforced bars 9 thereon fall downward to the lower stop plates 28' which are driven by the first cylinders 29' connected thereto, letting the reinforced bars 9 further fall onto the projected shafts 36 of the bending machine 3. When the reinforced bars 9 fall onto the projected shafts 36 of the bending machine 3, it is very possible that these reinforced bars 9 are not aligned with one another at two ends. Therefore, the left aligning board 51 of the base 5 is driven by the second cylinder 510 thereof to push the reinforced bars 9 toward the right stopping board and to cooperate with the right stopping board to align the reinforced bars 9 with one another. In addition, the tapered adjusting rods 71 of the adjusting devices 7 disposed in front of the bending units of the bending machine 3 are driven by the fourth cylinder 70 to move toward the reinforced bars 9 and together press the reinforced bars 9 so that they lie side by side on the projected shafts 36. Thereafter, the pressing rod 63 and the elevating board 65 of the fixing support 6 are simultaneously driven to horizontally extend and upward moved, respectively, by the horizontal and the vertical cylinders 64, 66, respectively, so as to tightly clamp the reinforced bars 9 for the subsequent bending operation.

Figure 9:
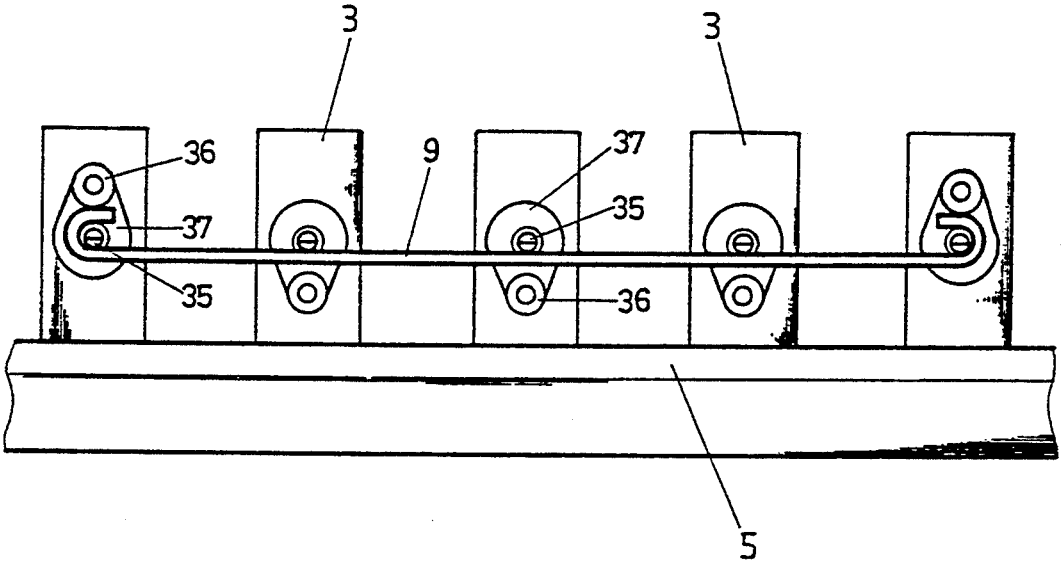
FIG. 9 shows that two ends of a reinforced bar are bent by the first and fifth bending units of the bending machine.
Figure 10:
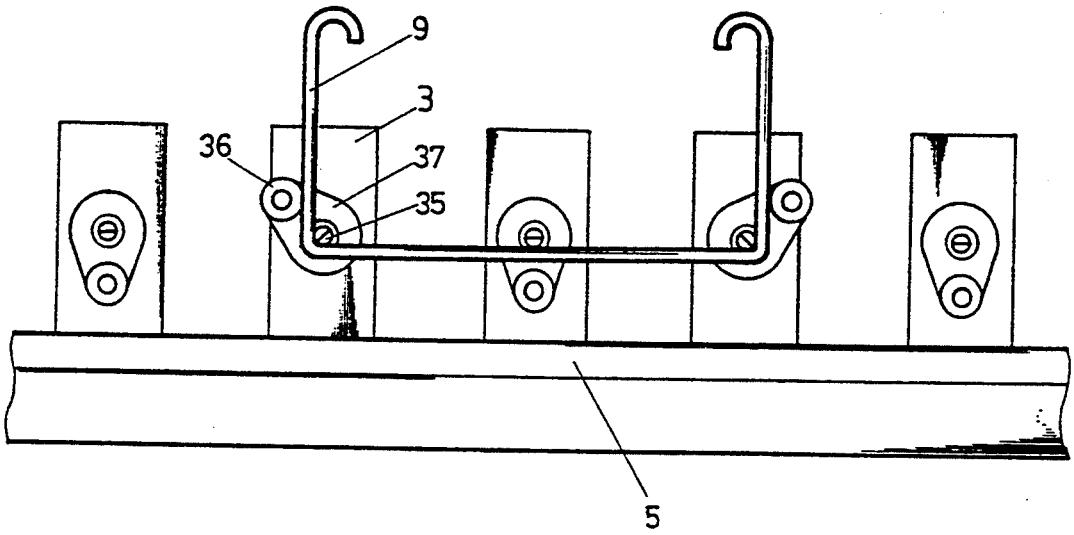
FIG. 10 shows that the reinforced bar of FIG. 9 is further bent by the second and fourth bending units of the bending machine.
Figure 11:
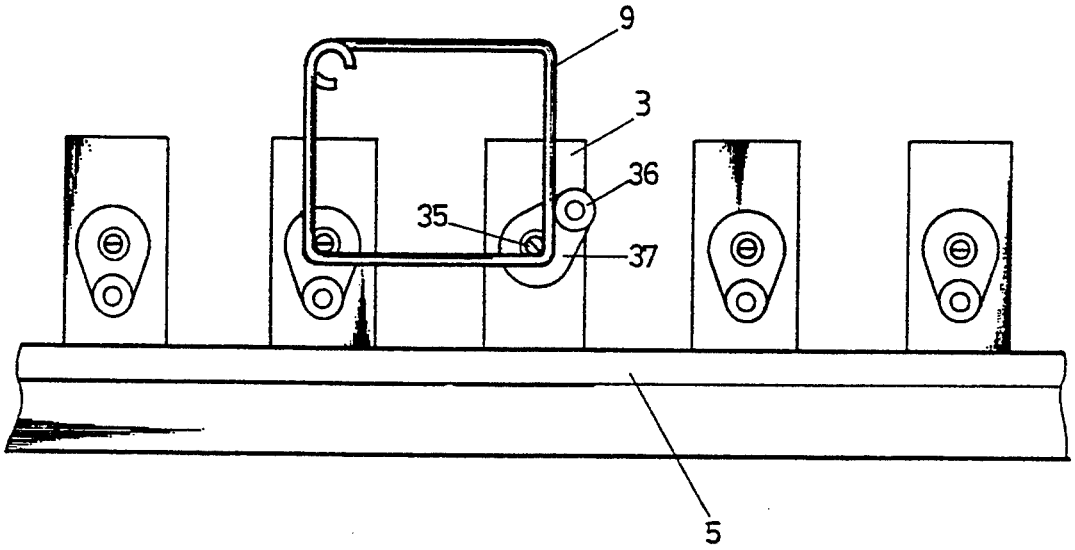
FIG. 11 shows that the reinforced bar of FIG. 10 is further bent by the third bending unit to form a square frame.

Please now refer to FIGS. 9 to 11. When bending a reinforced bar 9, the main sheets 35 of the first and the fifth bending units of the bending machine 3 are first driven by the third cylinders 38 thereof to extend forward just above the reinforced bar 9, the gear sets 32 are driven by the driving motors 31 to rotate the main shafts 35 and the operating disks 37 so as to bend two ends of the reinforced bar 9. Thereafter, as shown in FIG. 10, the second and the fourth bending units of the bending machine 3 are actuated in accordance with the same procedures as above described to further bend the reinforced bar 9 into a U-shape. Please Refer to FIG. 11. After the reinforced bar 9 is bent into a U-shape, the pushing member 83 of the biasing arm 8 extends to push the left side of the U-shaped reinforced bar so that the same is slightly biased from the biasing arm 8. Then, the third bending unit of the bending machine 3 is operated to bend the right side of the U-shaped reinforced bar 9 toward the left side so as to form a usable square frame. By this way, the two bent ends of the reinforced bar 9 could get as close as possible to each other without undesirably contacting each other when the reinforced bar 9 is finally bent into a square frame. After the pressing rod 63 and the elevating board 65 of the fixing support 6 are driven by the horizontal and the vertical cylinders 64, 66 to move backward and downward, respectively, the bent reinforced bar 9 can be taken out of the bending machine 3 and the above procedures can be repeated to bend the next reinforced bar 9.

According to the above procedures, multiple reinforced bars can be continuously bent into the square frames for use in construction with the advantage of reduced time and labor, while the quality of the products can be effectively controlled.

Additionally, the present invention can achieve the following advantages:

1. Before the bending operation is started, a predetermined small number of reinforced bars can be first separated from a large quantity of reinforced bars before they are transferred to the feeding machine in sequence.
2. Because the clearance between the toothed wheels of the moving carriage and the top surface of the second driving chains of the feeding machine allows the reinforced bars to pass therethrough one at one time, the small pile of reinforced bars conveyed by the second driving chains are smoothed by the toothed wheels without superposing with one another so that the reinforced bars can be correctly counted.
3. Each time the catch disks catch a reinforced bar, the sensor counts once so that the amount of the fed reinforced bars can be effectively controlled and counted.
4. The bending machine can automatically align the reinforced bars with one another before bending the same. Moreover, after each bending operation, the bending machine will automatically clean up the produced steel chips.

It is to be understood that the above description and drawings are only used for illustrating one embodiment of the present invention, not intended to limit the scope of the present invention. Any variation and derivation from the above description and drawings should be included in the scope of the present invention.

What is claimed is:

1. An automatic reinforced bar bending apparatus comprising a dispensing machine, a feeding machine located on a lower front side of said dispensing machine, and a bending machine located on a lower front side of said feeding machine;

said dispensing machine having a main-frame in a predetermined length, a plurality of upward inclined supporting arms for supporting multiple reinforced bars thereon disposed on a top portion of said main-frame at a predetermined interval and each having a downward extending front end and an upward extending rear stop member, a plurality of dispensing arms each disposed between two adjacent supporting arms and having a pivotally connected conic dispensing plate at its front end for moving excessive reinforced bars on said supporting arms toward said stop members of the supporting arms, and a shaft rod disposed at the front end of said supporting arms and having stop plates pivotally coupled thereto separately located near one side of said supporting arms and being rotatably displaced responsive to a control signal from a microswitch disposed below one of said stop plates closest to one lateral end of said dispensing machine; and each of said supporting arms further having a first driving chain which is connected to a first motor located under said dispensing machine via a rotary shaft of said first driving chain;

said feeding machine having a main-frame in a predetermined length corresponding to that of said dispensing machine, a plurality of conveying arms disposed on a top portion of said feeding machine corresponding to said supporting arms of said dispensing machine in both the numbers and the spaced intervals and each having a downward extending tapered front extension, and a sliding carriage disposed above said main-frame of said feeding machine; said sliding carriage consisting of a plurality of downward extended rods each of which having a toothed wheel rotatably disposed at a lower end thereof to control the passing of said reinforced bars to said tapered front extension of said conveying arms; said conveying arms each being further provided with a second driving chain which is connected to a second motor located under said feeding machine, a driving shaft disposed on said conveying arm near a front side of said second driving chain, a catch disk disposed on said driving shaft at one side of said conveying arm, and a vertical stop plate disposed between said catch disk and said second driving chain such that said vertical stop plate is connected with a clutch control box of said second driving chain; every two adjacent tapered front extensions of said conveying arms having two parallelly spaced shafts disposed therebetween, on said parallel shafts two arch hook-like stop plates being correspondingly disposed and being actuated by two first pneumatic cylinders disposed behind said arch hook-like stop plates; and a sensor being disposed on an outer side of one of said catch disks disposed at one lateral end of said feeding machine;

said bending machine being slidably seated on a base and consisting of a plurality of bending units each of which is powered by a driving motor mounted behind said bending unit such that said driving motor drives a main shaft inside said bending unit to turn by engaging with a gear set connected with said main shaft; said main shaft having a front end slightly protruded out of a front portion of said bending unit such that an operating disk is fitted over said protruded front end of said main shaft and a projected shaft is fixedly disposed on one end of said operating disk opposite to said main shaft while said main shaft can be actuated to extend outward by a third pneumatic cylinder connected behind said gear set; said base having a left aligning board and a right stopping board fixed to a left and a right end thereof, respectively; and said left aligning board being controlled to move by a second pneumatic cylinder disposed at a left side thereof for aligning one end of said reinforced bars to be bent;

said reinforced bar bending apparatus being operated in such a manner that a large number of reinforced bars are placed on said supporting arms of said dispensing machine and moved forward by said first driving chain thereof and when a predetermined amount of reinforced bars are moved to said stop plates of said dispensing machine and touch said microswitch, said first driving chain is stopped and then reversely rotated, so that said reinforced bars which have not entered said stop plates are moved back down to said rear stop members of said supporting arms by said dispensing plates of said dispensing arms, and meanwhile, said stop plate moves downward, permitting the reinforced bars located thereon to fall down to said conveying arms of said feeding machine and smoothed by said toothed wheels of said sliding carriage; after passing through said toothed wheels, said reinforced bars move to a front end of said conveying arms and touch said vertical stop plates, making the same to control said clutch control box to lock and stop said second driving chain, letting said reinforced bars enter said catch disks one by one, and once said sensor detects that one of said reinforced bars is actually located in said catch disks, the same are rotated to move said reinforced bar down to said hook-like stop plates of said parallel shafts, and each time said catch disks catch a reinforced bar, said sensor counts once until the counted number reaches a preset number of said reinforced bars to be bent, and when said preset number is reached, said first pneumatic cylinders of said hook-like stop plates drive the same to turn downward, letting said reinforced bars fall down onto said projected shafts in front of said bending units of said bending machine, whereby said main shafts of said bending units extend forward just above said reinforced bars and said main shafts and said operating disks are rotated so as to bend the reinforced bars into a square frame step by step.

2. An automatic reinforced bar bending apparatus as claimed in claim 1, wherein a clearance between said toothed wheels and a top surface of said second driving chain permits said reinforced bars to pass therethrough one at a time so that said reinforced bars delivered from said dispensing machine to said feeding machine are smoothed by said toothed wheels without superposing with one anther.

3. An automatic reinforced bar bending apparatus as claimed in claim 1, wherein said catch disks each has four catch levers; each of said catch levers having a front concave hook section abutting against a toothed adjusting block fixed on said catch disk and a rear end pivotably secured at one of four corners of said catch disk.

4. An automatic reinforced bar bending apparatus as claimed in claim 1, wherein said vertical stop plates control said clutch control boxes to lock and stop said second driving chains of said feeding machine or release and permit said second driving chains to go forward.

5. An automatic reinforced bar bending apparatus as claimed in claim 1, wherein after each rotation of said catch disks, a locating sensor will inform said catch levers of said catch disks a right position to stop so that said concave hook sections of said catch levers are located at a fixed position and wait to catch the next reinforced bar.

* * * * *